United States Patent [19]

Wentzell et al.

[11] 4,432,271

[45] Feb. 21, 1984

[54] LOCOMOTION UNIT FOR A TOOL SUPPORT ADAPTED FOR PROGRESSION THROUGH PASSAGEWAYS

[75] Inventors: Timothy H. Wentzell, South Windsor; Charles B. Innes, Jr., Granby, both of Conn.

[73] Assignee: Combustion Engineering, Inc., Windsor, Conn.

[21] Appl. No.: 293,541

[22] Filed: Aug. 17, 1981

[51] Int. Cl.[3] ..... F15B 13/06

[52] U.S. Cl. ..... 91/527; 73/633; 92/2; 254/134.6; 376/249

[58] Field of Search ..... 73/623, 633, 640; 91/508, 527; 92/2, 147, 148; 165/11 A; 254/106, 107, 134.6; 376/249, 231

[56] References Cited

U.S. PATENT DOCUMENTS

| | | | |
|---|---|---|---|
| 2,992,812 | 7/1961 | Rasmussen et al. | 254/107 |
| 3,780,571 | 12/1973 | Wiesener | 73/67.8 S |
| 3,809,607 | 5/1974 | Murray et al. | 376/249 |
| 3,862,578 | 1/1975 | Schluter | 376/249 |

*Primary Examiner*—Martin P. Schwadron
*Assistant Examiner*—Richard S. Meyer
*Attorney, Agent, or Firm*—Arthur L. Wade

[57] ABSTRACT

A locomotion unit is remotely controlled to advance stepwise through a passageway by frictional engagement with the surfaces of the passageway walls. A support section is mounted on the locomotion device to bring special tools to bear at predetermined positions within the passageway to which the support is brought by the locomotion unit.

7 Claims, 5 Drawing Figures

LOCOMOTION UNIT FOR A TOOL SUPPORT ADAPTED FOR PROGRESSION THROUGH PASSAGEWAYS

TECHNICAL FIELD

The present invention relates to the mechanical means for progressing special tools and/or inspection devices in a controlled manner to desired positions within a passageway. More particularly, the invention relates to a mechanism actuating the tools or inspection devices at the position to which they are brought.

BACKGROUND ART

For a utility operating a nuclear reactor system, it is imperative that Inservice Inspection (ISI) of the reactor system welds be performed as rapidly as possible without sacrificing accuracy. The inspection system is comprised of mechanical locomotion equipment and nondestructive examination instrumentation. It is desirable to reduce the time in making these inspections without reducing the quality of the examinations. Reduction in this time will enable the utility to realize savings in operating costs due to shorter downtimes and a reduction in radiation exposure to examination personnel.

The present rules for ISI, established by the ASME Code, Section XI "Rules for Inservice Inspection of Nuclear Power Plant Components", require a complete inspection of reactor vessel and steam generator welds every ten operational years. In addition, it is a USNRC requirement that personnel radiation exposure be "as low as reasonably achievable." Hence, it is inevitable, based on these criteria and the very high cost of plant downtime, that an inspection agency must provide reliable, accurate, and rapid inspection techniques.

The inservice inspection program includes both the component and piping welds. In general, there are numerous access problems, weld configuration variations and radiation hazards that must be considered. The stay cylinder of the steam generator is vertically extended. The mounting structure for the ultrasonic transducers must be inserted within a convenient manway and remotely controlled to progress vertically up the length of the cylinder. It has been the practice to provide a permanent track structure internally of the cylinder on which the transducer mount may progress.

The prior art track requires moving parts which may, over long periods of time, become inoperative to some degree. After all, inspections are every 10 years and after 40 years, deterioration of the track, and moving parts associated with it, can be expected. If a platform, or support structure, can be provided for the ultrasonic inspection deck which can be inserted through the convenient manway, and progress up the internal surface of a cylindrical shaft, the inspection deck can be mounted thereon and be brought to its weld bodies requiring the inspection without reliance upon the mechanical complications of a track. There will be no sacrifice of positional precision. The platform, or support structure, will be actuated to progress by remote control and the intelligence from the transducers will be transmitted to the remote location for the personnel.

The specific problems of inspecting the vertical stay cylinder of the nuclear steam generator triggered awareness of the more broadly defined problem. Not only vertical stay cylinders may require inspection and other work at predetermined areas, but any passageway in tne nuclear reactor system has similar requirements.

Further, the requirement of inspection and other work associated with pssageways with various cross-sectional configurations exist elsewhere other than the nuclear reactor systems. The progressed support structure for attached tools is demanded anywhere the elongated passageways require remote control to position working tools to specific areas along the passageways.

DISCLOSURE OF THE INVENTION

The present invention contemplates a body having a platform area on which special tools are to be mounted and having radially extended at least two sets of contact members which will engage the internal surface of a passageway with sufficient radial force and friction to progress the body along the axis of the passageway. Control of the actuation will progress the body along the passageway to bring the tools mounted thereon into desired engagement with predetermined areas within the passageway so that useful work may be carried out.

The invention more specifically contemplates that the locomotion unit is detachable from the tool support body to facilitate their separate insertion into the vestibule at the base of the stay cylinder. This separation is required due to the limited size of the manway which is the entry to the vestibule. A technician reassembles the parts while he is within the vestibule. The connection is made quickly and the entire assembly is inserted into the lower end of the stay cylinder. The technician then exits and the device is ready to receive commands for progress from a remote operator.

The invention more specifically contemplates the tools mounted on their supporting platform be actuated in bringing inspection devices over areas to be inspected within the passageway and/or tools to carry out work procedures at the predetermined areas.

Other objects, advantages and features of this invention will become apparent to one skilled in the art upon consideration of the written specification, appended claims, and the attached drawings.

BRIEF DESIGNATION OF THE DRAWINGS

BEST MODE FOR CARRYING OUT THE INVENTION

Drawing Disclosure Plan

Figure 1:
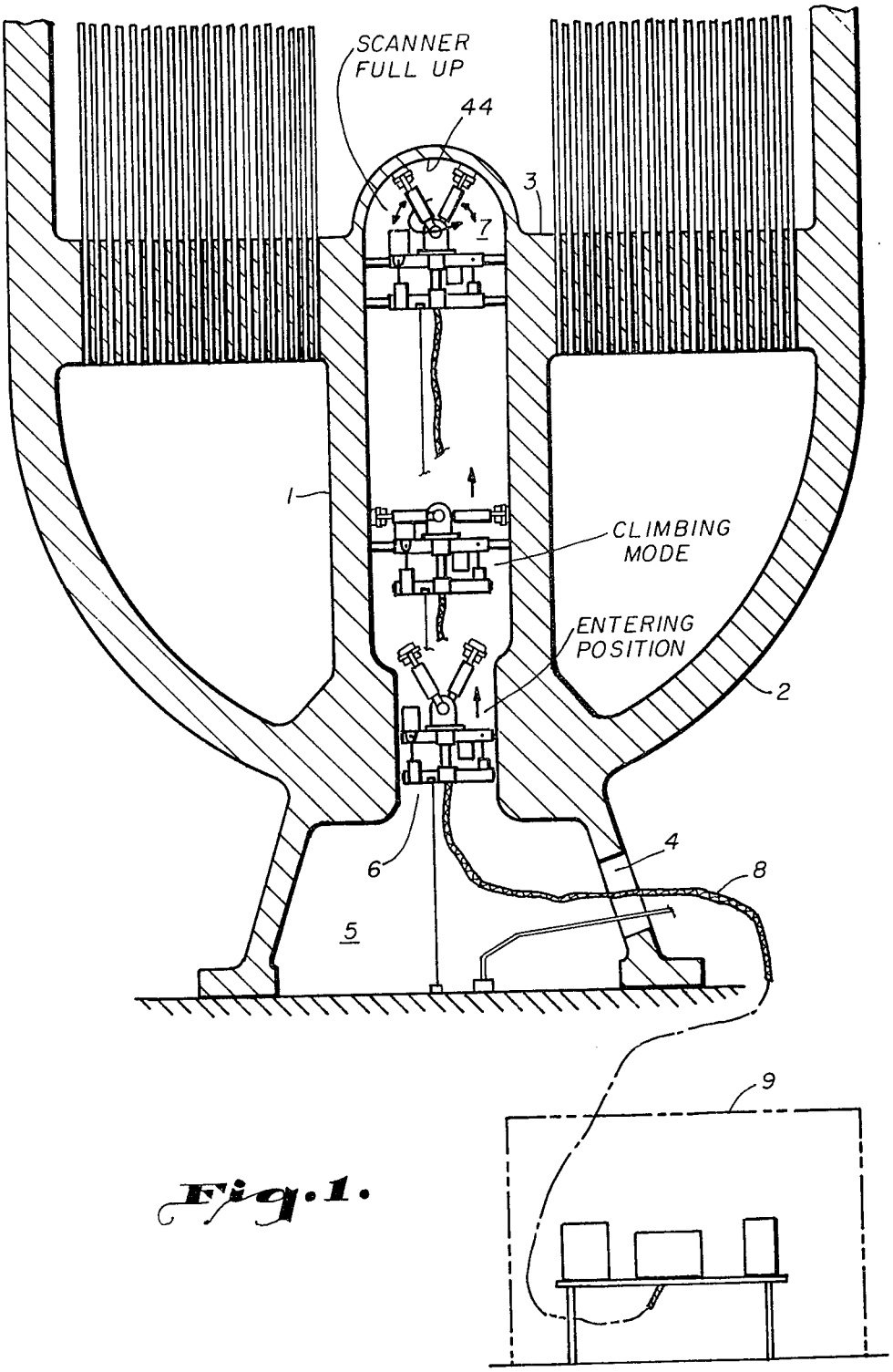
FIG. 1 is a sectioned elevation of a stay cylinder of a nuclear steam generator into which the structure embodying the present invention is inserted to carry out examination of the cylinder interior.

FIG. 1 shows a stay cylinder of a nuclear steam generator heat exchanger as representative of any elongated passageway which can be inspected by the embodiment of the present invention. It is necessary to give but a brief description to orient the reader relative to the environment in which the present invention functions.

In an attempt to compartment study of the inventive embodiment, a first drawing is limited to the locomotion section of the embodiment, and a second drawing is allocated to the support for the special tools positioned by the locomotion section.

Passageway Environment

Figure 2:
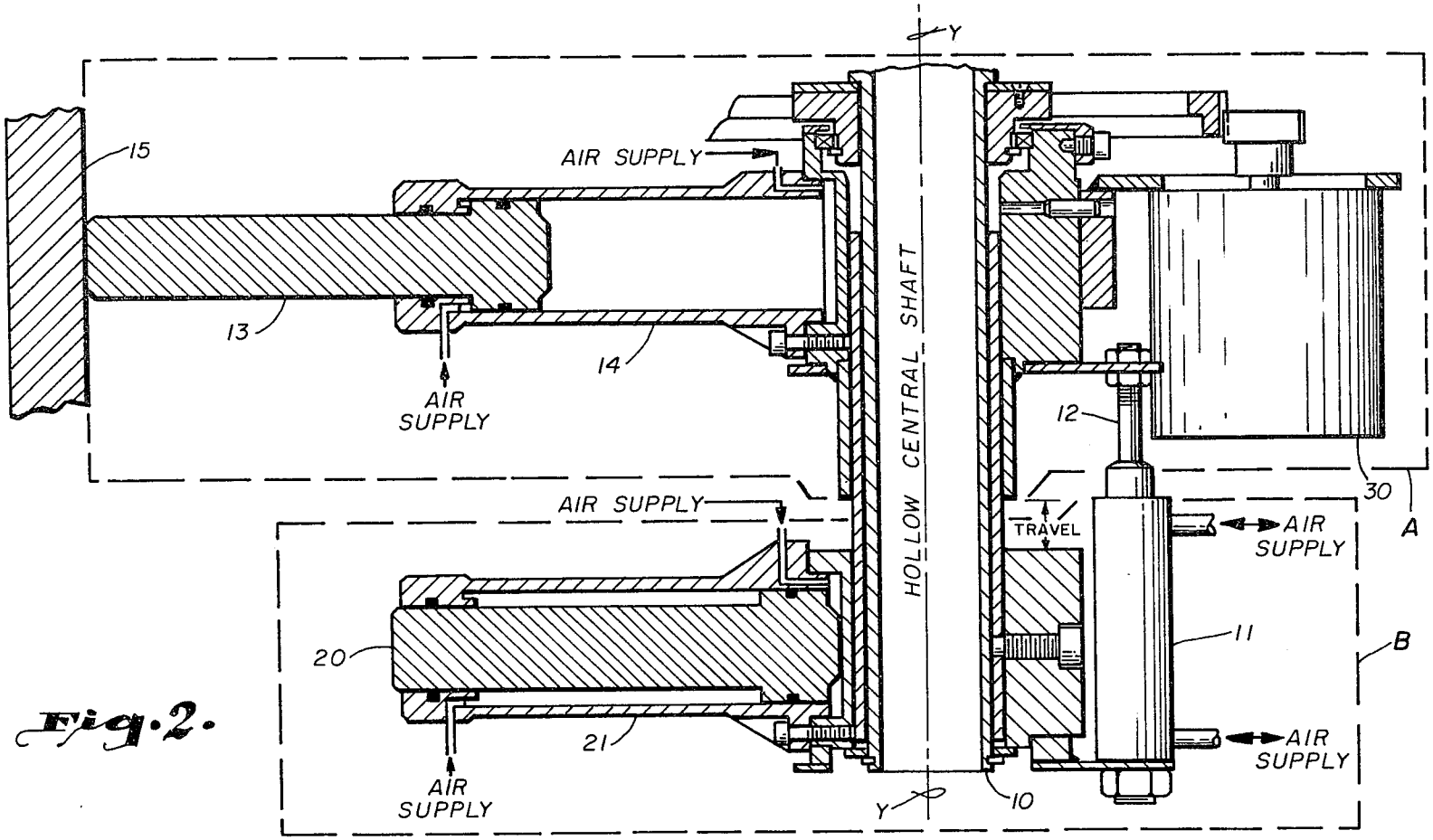
FIG. 2 is a sectioned elevation of the locomotion section, only.

In connection with FIG. 2, caution is admonished in perceiving the stay cylinder as merely representative of the various passageways with which the present invention may be associated. Stay cylinder 1 is the central support within heat exchange vessel 2 which houses heat exchange sections of a nuclear steam generating system. The stay cylinder is a support for a tube sheet 3 within vessel 2. The invention is called upon to internally inspect the welds along the internal wall of stay cylinder 1.

The present invention boosts ultrasonic inspection probes up to predetermined positions within the stay cylinder so the probes may be moved over the welds at the predetermined position for inspection of their integrity. As stay cylinder 1 merely represents any passageway along which the embodiment of the invention is progressed, only generalization need be indulged in as far as access is concerned. In the vessel support structure, a manway 4 is provided into a vestibule 5. An opening 6 is provided in the bottom of stay cylinder 1. The locomotion and special tool (inspection) support 7, embodying the invention, is manually thrust up into the interior of stay cylinder 1 through opening 6. Control and communication of and with the unit 7 is maintained through lines 8 which terminate at a control station 9, located a safe distance externally of the radiation-containing vessel 2.

Initially lodged in the bottom of stay cylinder 1, the unit embodying the present invention is actuated to progress along cylinder 1, as a passageway, until the special tools, supported on the unit 7, are brought to predetermined positions where they may function as intended.

The locomotion of unit 7 is made possible by frictional engagement between legs of unit 7 and the internal surface of the passageway. Originally conceived as climbing, or shinnying, up a vertical stay cylinder, unit 7 could, as well, progress along a passageway extending horizontally, or at any angle to the vertical. The basic point to be made in connection with FIG. 1 is that the environment for the unit 7 is a passageway having any cross-sectional configuration which will enable the legs of unit 7 to be planted firmly against the internal wall of the passageway. Secured by frictional contact with the internal wall, unit 7 can move its special tool support to any desired position to carry out any operation for which its tools have been designed. The locomotion section of unit 7 and the tool support may be taken separately into vestibule 5, connected together, and thrust into their initial position within the passageway of cylinder 1. Subsequently, control is exerted from station 9 and information is relayed back to station 9 through control lines 8.

Locomotion Device or Section

Referring to FIG. 2, all of the structure embodying the invention is oriented relative to a central shaft 10. The legs of the locomotion device radiate from a housing journaled over this shaft 10. Shaft 10 extends beyond the locomotion section to form the central support structure for the inspection device connected to the locomotion section.

As far as the locomotion section is concerned, it will be considered to consist of two halves, each mounted on the common central shaft 10. Half A is fixed to shaft 10, while half B is reciprocated along shaft 10 to advance the entire unit 7 along its passageway. Thus, half A and half B reciprocate toward and away from each other in carrying out the locomotion function.

Cylinder 11 is mounted on half B. Piston 12 is received within cylinder 11 and connected to half A. With fluid pressure applied to one end or the other of cylinder 11, piston 12 is reciprocated. When halves A and B are alternately engaged with the internal wall of the stay cylinder as a passageway, the reciprocation of piston 12 in cylinder 11 will progress, or locomote, everything attached to the halves A and B. More specifically, shaft 10, and all its attachments, is progressed as a unit 7.

Legs are formed as piston rods which are radially extended from the halves A and B to engage the internal passageway wall. In FIG. 2, a single leg is disclosed for each half of the locomotion section. Of course, a plurality of legs will have to be provided to extend radially outward from shaft 10. A minimum of three legs will probably be required. In FIG. 2, a single leg is shown for each half to represent all legs for each half. The legs of one of the halves are all moved radially from shaft 10 at the same time from a common fluid pressure.

Half A is disclosed with representative leg 13 extended outward from its cylinder 14 into engagement with passageway internal surface 15. Of course, fluid pressure has been appropriately applied to that end of cylinder 14 to radially project leg 13 into the engagement with wall 15. Whereas, representative lg 20, mounted in its cylinder 21, is disclosed in its retracted position to maintain half B disengaged from wall 15. The operation of this structure can now be readily understood.

With half A anchored to wall 15 and shaft 10, half B can be drawn up to half A, sliding along shaft 10. The power for this movement is provided by the fluid pressure applied to cylinder 11 to draw piston 12 down into cylinder 11. Once advanced along shaft 10, half B is then engaged with wall 15 by radially extending its legs, represented by leg 20, into engagement with wall 15. Subsequently, the legs of half A, represented by leg 13, are withdrawn from engagement with wall 15. Then, fluid pressure is applied to force piston 12 outward from cylinder 11 with the resulting advancement of all the structure attached to piston 12, i.e. half A, shaft 10 and its attachments. It should be noted that there is a moment at the end of each cycle when the legs of both halves are all engaging the wall 15, thus preventing back-sliding. The cycle can then repeat as often as desired, locomotion taking place in the increments measured by the stroke of piston 12 within cylinder 11.

Obviously, a group of fluid pressure lines to cylinders 11, 14, and 21 must be provided to carry the fluid pressures necessary to be applied at the proper times and for the correct intervals to carry out the cycles of locomotion. The addition of these fluid pressure supply lines would needlessly encumber this figure. They are sufficiently represented in FIG. 1 at 8. It is glaringly apparent that the control of these fluid pressures is centralized and coordinated from central location 9 depicted in FIG. 1. The disclosure is more fruitfully occupied with shifting attention to the special tool supply structure mounted on shaft 10 as it extends beyond the locomotion section.

Tool Support and Actuation Section

Again, all of the structure of the embodiment of the invention is oriented about shaft 10. This shaft 10 is moved, usually axially, along its passageway. As disclosed, the support structure, or inspection deck, revolves around the upper end of shaft 10. Communication with the special tools supported is had by means of fluid pressure and electrical conduits 8 extended up through the hollow shaft 10. Again, these conduits are not included in FIG. 3 as a needless complication to disclosure of the invention.

It has been previously disclosed in FIG. 2 how half A is fixed against axial movement along shaft 10 in order for the reciprocation of piston 12 to provide the locomotion required. Shaft 10 may rotate relative to the locomotion section, but not reciprocate relative to half A.

Figure 3:
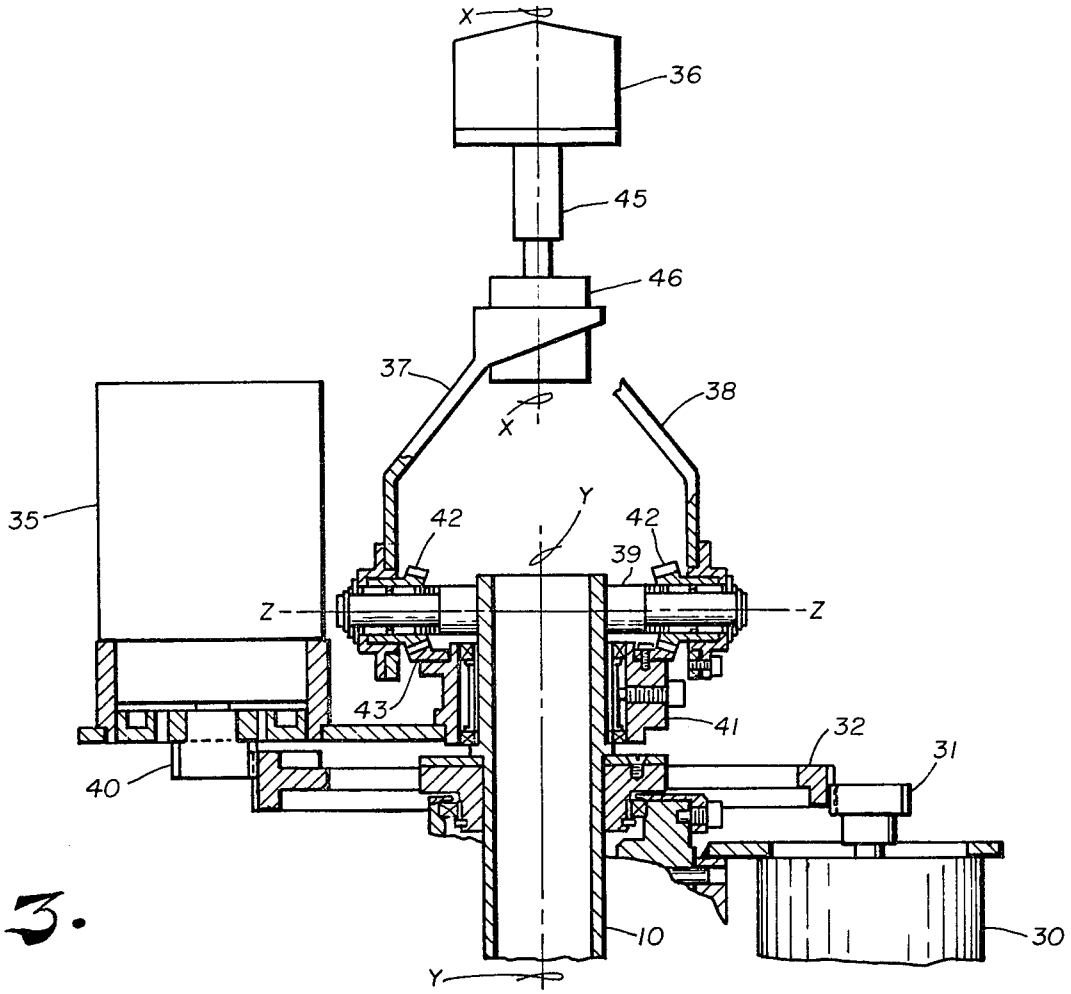
FIG. 3 is a sectioned elevation of the tool support structure as it is mounted on the locomotion unit of FIG. 2.

See FIG. 3. Rotation of shaft 10 is carried out by motor 30. Motor 30 is mounted on half A and extends its pinion gear 31 into engagement with the peripheral teeth of sun gear 32. Sun gear 32 is fixed to shaft 10 so that rotation of one is rotation of the other. Therefore, once the special tool section attached to the upper end of shaft 10 is locomoted to its position, shaft 10 may be rotated as desired by motor 30. All that remains is the movement of special tools by structure connected to sun gear 32. Motor 35 provides the movement for the special tools.

In relating shaft 10 to half A of the locomotion device and the tool support and actuation structure, the separation of the locomotion device from the tool support structure should not be obscured. It has been previously described that these two structures can be taken into a passageway separately and assembled, or connected, for subsequent locomotion. It is specifically pointed out that shaft 10 stays with the tool section. The lower end of shaft 10 is inserted down through half A and half B. Half A is secured to the collar of sun gear 32 by suitable screws. When so secured, pinion gear 31 is engaged with the peripheral teeth of sun gear 32. Therefore, connection, or assembly, is made at this point and the foregoing description of the relationship of the shaft 10 to the structures of both the locomotion device and tool support structure holds as previously, and subsequently, set forth.

Although it is contemplated that the invention will utilize a large range of special tools, all such devices will be represented by ultrasonic scanning probes designed to detect flaws in welds on the internal surface of the passageway, including the dome 44 at the top of the stay cylinder disclosed in FIG. 1. A general representation is made of the ultrasonic inspection units at 36. An ultrasonic unit is supported by an arm. Specifically, arms 37 and 38 are disclosed as support for a pair of ultrasonic units, and these arms are mounted on and pivoted about shaft 39. Shaft 39 is mounted on the end of shaft 10 and at a right angle to its axis. The centerline of shaft 10 is designated as axis Y, and the centerline of shaft 39 is designated as axis Z. Therefore, as motor 30 rotates shaft 10, arms 37 and 38 are pivoted about axis Y to carry their ultrasonic probes over welds on surface 15.

Figure 4:
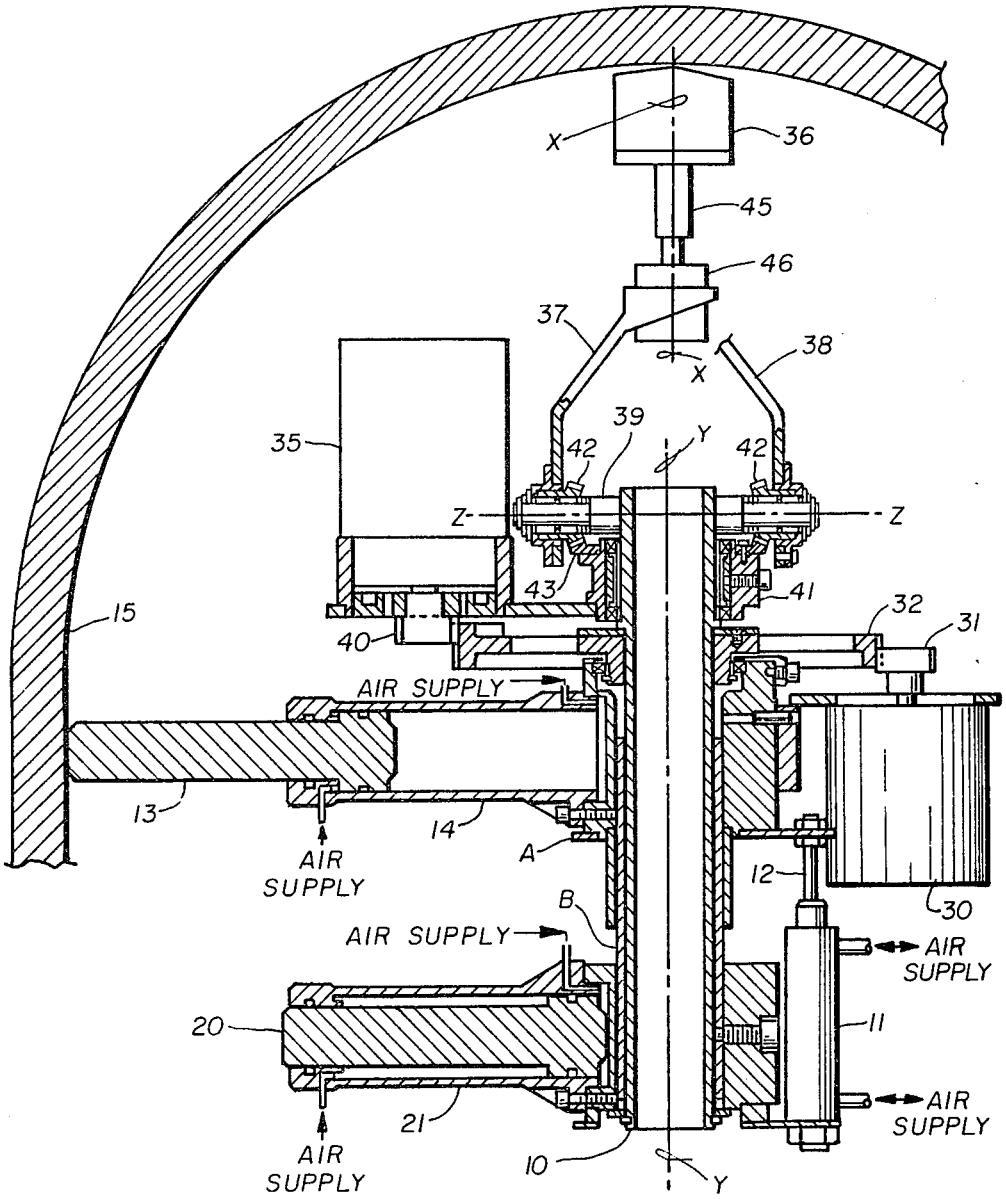
FIG. 4 shows the units of FIGS. 2 and 3 connected together, making the complete assembly.

The angular arc range of arms 37 and 38 about axis Z is controlled by motor 35. Motor 35 engages it planet gear 40 with teeth on sun gear 32. Motor 35 is mounted on bevel gear support 41 which is mounted on bearings to rotate on shaft 10. The connection is completed by bevel pinion gears 42 engaging bevel gear 43. In the specific inspection tool disclosed, it is required to sweep the welds of spherical dome 44 (disclosed in FIG. 1) with the inspection probes represented by 36. Arms 37 and 38 are therefore designed for controlled pivoting about axis Z. Prior to this operation, motor 30 and, hence, gear 31 are locked against rotation. When motor 35 rotates gear 40, it will orbit around sun gear 32, thus turning bevel gear 43 about axis Y. FIG. 4 shows a structural linkage of motor housing 35 to bevel gear housing 41 and to bevel gear 43. The turning of bevel gear 43 causes bevel pinions 42 to rotate. In this phase of operation, pinions 42 will not orbit about axis Y due to the fact that all the pinion support structure, consisting of shaft 39, shaft 10, sun gear 32, and gear 31, are locked against rotation by motor 30.

Figure 5:
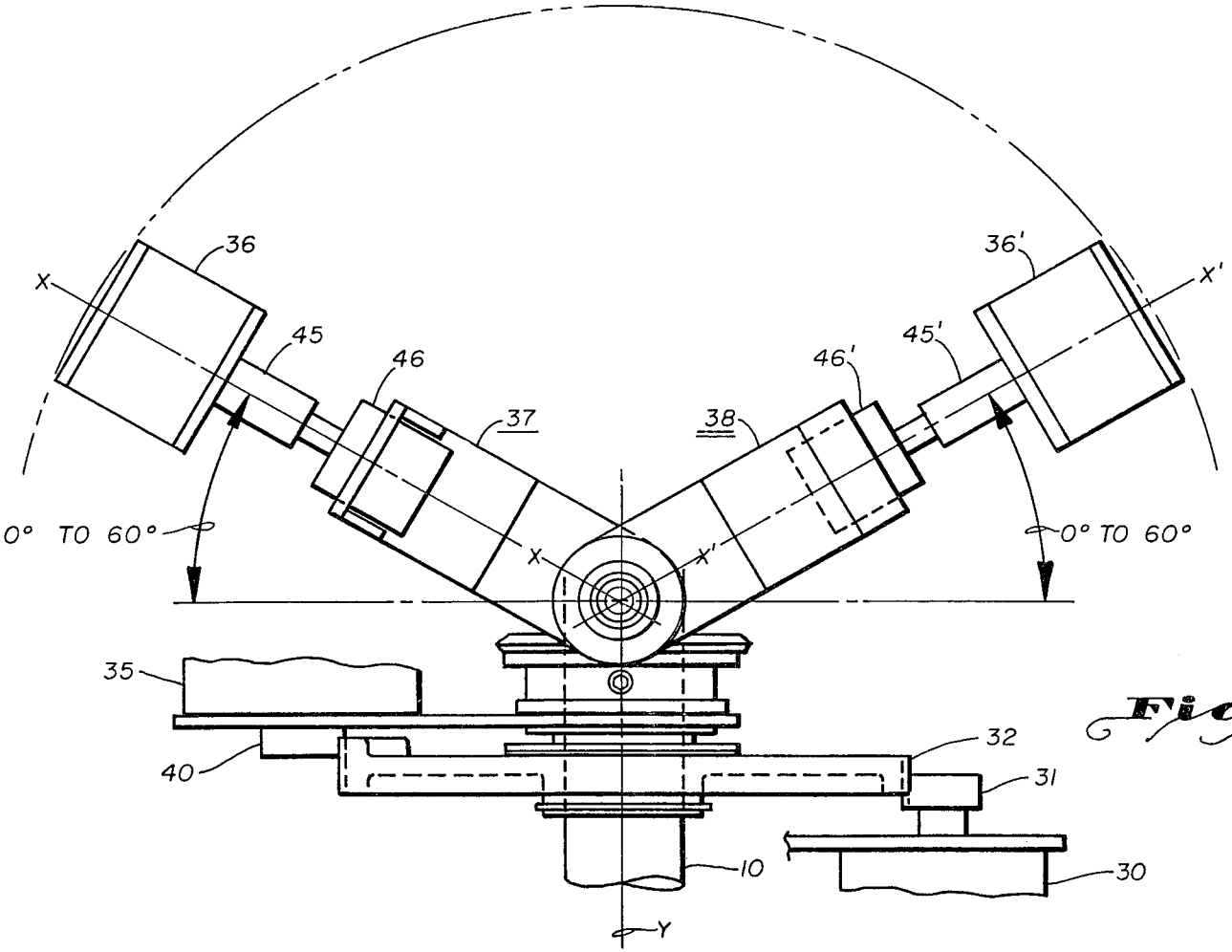
FIG. 5 is a side elevation of the tool support structure looking 90° about axis Y—Y relative to the view of FIG. 4.

The foregoing actuation of the probe-bearing arms 37 and 38 is made additionally clear by reference to FIG. 5. FIG. 5 is a view of shaft 39 rom its end. Arms 37 and 38 are depicted in their entirety as they are pivoted about axis Y to scan the welds from the inside of dome 44. FIG. 5 depicts shaft 39 immobile at a point in its rotation by shaft 10. Rotation of planet gear 40, by motor 35 through its engagement with teeth on sun gear 32, will cause rotation of pinion gears 42, 42'. As previously disclosed, the link afforded by bevel gear support 41 between motor 35 and gears 43 and 43' will actuate the pinion gears 42, 42' to bring about their rotation about axis Z on shaft 39. Rotation of these pinion gears 42, 42' will bring about rotation of arms 37, 38 about axis Z of shaft 39. Therefore, FIG. 5 discloses arms 37, 38 carried through arcs extending from the horizontal upward. In other words, the arms' axes X and X' are carried through a predetermined arc which will transport the probes 36 and 36' over their inspection paths.

Pause, for a moment, to consider that the present structure disclosed by FIGS. 4 and 5, position shaft 10 in its 360° rotation so that the pivoting of arms 37 and 38 will sweep their axes X and X' through their predetermined arcs in passing over any weld on the inner surface of dome 44. Each arm must incorporate yielding-/urging structure which will enable its probe to travel over the irregular surface of the welds being scanned. To this end, each arm contains a structure at 45 comprising a grooved rod, ball bearing bushings, and a spring. This structure is not disclosed in detail, but its location is indicated at 45, 45' on each of the arms 37 and 38.

See FIG. 5. Additionally, each probe must be rotated about its axis X, X' to alter its sound entry angle relative to the weld. To this end, a mechanism is included in the arms at 46, 46'. Neither the structure at 45, nor the structure at 46 is disclosed in detail as they are well-known prior art structures. Only their locations on their respective arms are indicated. FIG. 5, then, indicates the simultaneous sweep of arms 37, 38 upward from their horizontal limits to carry their probes 36, 36' yieldingly over the surface of welds while the arms are rotated about their axes X, X'.

Concern with disclosing the particular tools' (probes 36, 36') movement from the support structure must not obscure the fact that these tools only represent one of many other forms. The concept of the invention includes any tool which can be attached to the locomotion device, moved to a selected location, and actuated to perform work at the selected location within the passageway. The probes, and their actuating structure, mounted on the end of shaft 10 represent all tools which can be adapted to function at this position.

Conclusion

It is a fundamental concept of the present invention that a locomotion device is provided to engage facing surfaces of a passageway to move the device along the length of the passageway. Of course, there are many details under this concept. The locomotion device is analyzed in its two halves which reciprocate toward and away from each other. The two locomotion halves alternately engage the facing surfaces of their passageway so that their reciprocation toward and away from each other will progress both halves, as a unit.

As a unit, the locomotion section provides a foundation for tools with which work is carried out at predetermined locations within the passageway. In operating the tools, universal motion is provided by two motors. A first of the motors is connected between the locomotion section and the platform for the tools in an arrangement to rotate the platform in a plane normal the axis of the passageway. The second motor is mounted on the tool platform and coupled to the tools in order to move them in planes parallel with the axis of the passageway. The combination of the movements provided by the two motors enables the tools to be manipulated as required to service any surface within the passageway.

The locomotion device, or section, is connected to the tool foundation, or platform, in such a manner that the two can be disconnected and reconnected as desired. It is contemplated that the side entry into the passageway provided for the locomotion device and tool support structure is so sized as to require their separate insertion. Provision is made for the two sections to be disconnected for insertion and reconnected within the passageway. Once in place within the passageway, the connected locomotion device and tool support structure are both controlled from a remote station.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

We claim:

1. A locomotion unit adapted to travel between facing surfaces of a passageway in positioning and supporting a special tool which carries out operations within the passageway, including, a passageway having a pair of facing surfaces, a shaft oriented to extend its axis lengthwise between the pair of facing surfaces, a first fixture connected to the shaft at a position intermediate the ends of the shaft, a first set of fluid pressured cylinders mounted on the first fixture from which pistons are reciprocated radially from the shaft axis into and out of engagement with the facing surfaces, a second journaled over and slidable along the shaft, a second set of fluid pressured cylinders mounted on the second fixture from which pistons are reciprocated radially from the shaft axis into and out of engagement with the facing surfaces, a piston-cylinder structure connected between the first and second fixtures, a first fluid pressure means connected to the cylinders of the first and second fixtures controlled to alternately extend and retract the pistons of the first fixture relative to the pistons of the second fixture, a second fluid pressure means for the cylinder of the piston-cylinder connecting the fixtures controlled to alternately move the fixtures toward and away from each other along the shaft axis in coordination with the alternate reciprocation of the pistons of each fixture to cause locomotion of the shaft between the facing surfaces, and a tool mounted on an end of the shaft to carry out a predetermined function at a position within the passageway to which the tool is moved by the locomotion of the shaft.

2. The locomotion and tool units of claim 1, wherein, a control station for the units is established remote from the passageway, and fluid pressure conduits are extended between the control station and the locomotion unit with which to apply fluid pressure to the cylinders of the first and second fixtures and the piston-cylinder in the sequence to carry out the locomotion.

3. The locomotion and tool units of claim 1, wherein, the shaft is hollow and rotates within its connection to the first fixture means, and the tool unit is connected to the end of the rotating shaft to be actuated by the shaft rotation.

4. The locomotion and tool units of claim 3, including, a motor mounted on the first fixture means, and a gear connection between the shaft and the motor through which the shaft is rotated to actuate the tool unit.

5. The locomotion and tool units of claim 4, including, control lines connected to the tool unit and extending through the shaft to the remote control center for manipulation of the tool unit and manifesting at the control center the result of its manipulation.

6. The locomotion and tool units of claim 4, wherein, the gear connection between the motor mounted on the first fixture and the shaft includes a gear mounted on the shaft and extending normal to the axis of the shaft.

7. The locomotion and tool units of claim 6, including, a second motor mounted to revolve around the shaft and engaging the gear mounted on the shaft so that actuation of the second motor will cause limited travel of the second motor about the shaft, and a tool unit mounted on the second motor and moved by the combination of motions produced by the first and second motors.

* * * * *

UNITED STATES PATENT AND TRADEMARK OFFICE

CERTIFICATE OF CORRECTION

PATENT NO. : 4,432,271

DATED : February 21, 1984

INVENTOR(S) : Timothy H. Wentzell and Charles B. Innes, Jr.

It is certified that error appears in the above—identified patent and that said Letters Patent is hereby corrected as shown below:

Column 1, line 68; change "tne" to --the--
Column 2, line 2; change "pssageways" to --passageways--
Column 4, line 35; change "lg" to --leg--
Column 6, line 21; change "rom" to --from--
Column 6, line 43; after "yielding" delete " - "
Column 8, line 5; after "second" insert --fixture--

Signed and Sealed this

*Ninth* Day of *October 1984*

[SEAL]

*Attest:*

GERALD J. MOSSINGHOFF

*Attesting Officer*

*Commissioner of Patents and Trademarks*